United States Patent [19]

de Fenffe

[11] 4,079,895

[45] Mar. 21, 1978

[54] DEVICE FOR WINDING TOROIDAL DEFLECTION COILS

[75] Inventor: Michel Jules Henri Marie Joseph Delvaux de Fenffe, Heverlee, Belgium

[73] Assignee: U.S. Philips Corporation, New York, N.Y.

[21] Appl. No.: 717,551

[22] Filed: Aug. 25, 1976

Related U.S. Application Data

[63] Continuation of Ser. No. 479,905, Jun. 17, 1974, abandoned.

[30] Foreign Application Priority Data

Jun. 20, 1973 Netherlands ..... 7308546

[51] Int. Cl.[2] ..... H01F 41/08

[52] U.S. Cl. ..... 242/4 B

[58] Field of Search ..... 242/4 B, 4 BE, 4 C, 242/4 A, 4 R, 6; 29/203 R

[56] References Cited

U.S. PATENT DOCUMENTS

| | | | |
|---|---|---|---|
| 1,500,984 | 7/1924 | Derry | 242/6 |
| 1,811,229 | 6/1931 | Fries et al. | 242/6 |
| 2,974,890 | 3/1961 | Davis | 242/4 B |
| 3,125,307 | 3/1964 | Buralli | 242/4 B |
| 3,559,899 | 2/1971 | Fahrbach | 242/4 B |
| 3,799,462 | 3/1974 | Fahrbach | 242/4 B |

*Primary Examiner*—Harvey C. Hornsby
*Assistant Examiner*—John M. Jillions
*Attorney, Agent, or Firm*—Frank R. Trifari; David R. Treacy

[57] ABSTRACT

A device for winding toroidal deflection coils. A rotatable winding wheel has at least one annular flange on which a number of rollers which are each rotatable about their axis are provided, and is mounted on a frame for displacement with respect to the core to permit winding slant coils along geodetic lines, without developing slack in the wire being taken off.

5 Claims, 3 Drawing Figures

DEVICE FOR WINDING TOROIDAL DEFLECTION COILS

This is a continuation, of application Ser. No. 479,905, filed June 17, 1974, now abandoned.

BACKGROUND OF THE INVENTION

1. Field of the Invention

The invention relates to a device for winding toroidal deflection coils comprising a toroidal core, the device having a rotatable winding wheel comprising a wire take-off device and a removable portion through which the core can be arranged on means for holding and rotating said core.

2. Description of the Prior Art

A device of the kind set forth is known from U.S. Pat. No. 3,559,899. In this known device the winding wheel consists of an annular gear-wheel which supports a small wire take-off wheel. Adjacent the winding wheel a drivable wire feed reel is arranged. The winding wheel as well as the feed reel pass through the interior of the core during winding. Because the feed reel and the winding wheel together have a rather large diameter, and because the wire take-off wheel must be in the center of the core, cores having very small diameter openings cannot be wound by device of this type.

Before winding can be started, the required quantity of wire must be wound onto the feed reel.

Large tensile forces are exerted on the wire whenever large dimensions of the winding wheel and feed reel cause speed variations during winding.

SUMMARY OF THE INVENTION

The object of the invention is to provide a toroidal winding device for deflection coils, having minimal speed variation during winding and permitting winding onto the core without pre-loading a reel.

According to the invention, turns on the inner surface of the core are made to extend along a geodetic line by arrangement of the winding wheel with respect to the core such that the winding wheel is near to the inner surface while that is being wound. The center of the winding wheel therefore cannot always be situated between the envelope of the turns on the outside and the inner surface of the core. According to the invention the winding wheel is arranged such that it can be moved in the vertical direction. During the deposition of the turn on the inner circumference of the core the winding wheel is then situated near to this inner surface, while during the deposition of the outer turn the wheel is displaced such that no wire need be taken back onto the wheel.

In a preferred embodiment of a device according to the invention the winding wheel is formed by at least one annular flange supporting a number of rollers which are rotatable about their axes.

Because of the special construction of the winding wheel, a supply of wire can be wound onto the winding wheel from the outside, and this wire can be unwound again from the inside with the same direction of rotation of the winding wheel. This means that the wire can be directly wound from the inside onto the core to be wound, while at the same time being wound from a feed reel onto the wheel where it forms another supply. Because the circumference of the winding wheel is larger than one complete turn on the core, after a given number of revolutions the winding wheel will contain a sufficient quantity of wire for completely winding the core. At that instant the wire feed is interrupted. The winding is continued until the core has been completely wound and the wire supply on the winding wheel has been used up. Compared with prior art devices, the time required for filling the feed reel is thus saved, while the maximum wire supply required on the winding reel is reduced.

When the wire is accelerated or decelerated, only the mass of the wire supply and the movement of the rollers about their axis is of importance. This produces only limited inertia forces.

Because only one wheel is present, cores of small diameter can also be wound using the device according to the invention.

In a further preferred embodiment of the device according to the invention, the diameter of the winding wheel is so small that the center of the winding wheel can be positioned in a location between the envelope of the turns on the outer side of the core and the inner surface of the core.

A winding wheel of small diameter offers the advantage that the accelerations and decelerations of the wire are small. If, moreover, the centre of the winding wheel is situated between the envelope of the turns on the outside and the inner surface of the core, it is no longer necessary, as in known devices, to take back wire over part of a revolution.

In still a further embodiment of the device according to the invention a number of clamping rollers are provided for the one core head face and also a number of rollers for the other head face, so that the core can rotate over the relevant rollers, a programmable motor being provided which engages a gear ring on the core by way of a gearwheel or toothed-belt transmission.

In a device of this kind the core can be wound over fully 360° in one clamping operation. Due to the coupling of the motor and core, the core can be accurately positioned very quickly. It is quite feasible to arrange the wire on the one head face in a given radial plane and to turn the core quickly through a given angle so that the wire is arranged in a different radial plane on the other head face, with the result that a slanted turn is produced.

By suitable programming of the motor, adapted to the movement of the winding wheel, any desired distribution of the turns over the core and any degree of slant of the turns can be achieved.

A motion can be superimposed on the core motion required for distribution and slant of the turns to ensure that each of the turns on the inner surface of the core extends according to a geodetic line that is, a line between two points on the surface which is the shortest line between these points. Another possibility of realizing this geodetic line according to the invention is to mount the winding wheel on a frame with a shaft whose axis coincides with that of the core, and to have the winding wheel perform a swinging motion about that shaft.

In a further preferred embodiment yet in which the winding wheel center can be situated in the described location, a wire guide is arranged near to the inner surface of the core in the plane of the winding wheel.

BRIEF DESCRIPTION OF THE DRAWING

The invention will be described in detail hereinafter with reference to the drawing in which.

DETAILED DESCRIPTION

Figure 1:
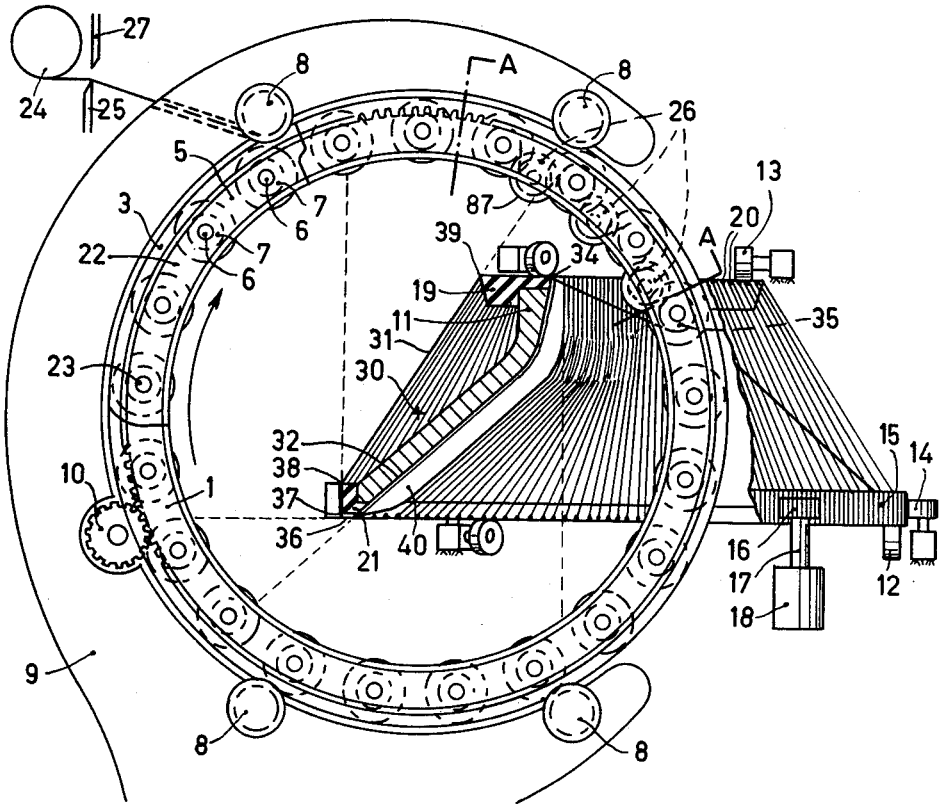
FIG. 1 is a diagrammatic perspective view of a winding device.

The reference 1 in the drawing denotes a winding wheel. In this embodiment the winding wheel consists of two annular flanges 2 and 3 which are provided with a gear ring 4, 5 respectively, on their outer side.

The two flanges 2 and 3 are linked by a large number of shafts 6 on which rotatable rollers 7 are secured.

The winding wheel is journalled to be rotatable on a number of guide wheels 8 which are journalled in a frame 9.

The wheel can be driven by a pinion 10 which is connected to a motor.

A toroidal core 11 is arranged in the device between a number of rollers 12 which support the one head face, a number of rollers 13 which press the upper head face, and a number of rollers 14 which engage on the side of the gear rings of the core 11 and ensure that the core cannot be laterally moved. A gear ring 15 is engaged by a pinion 16 which is connected to a motor 18 via a shaft 17. The core 11 is provided on its upper head face with a ring 19 of synthetic material which is provided with notches 20 in which the turns can be arranged. The core is provided on its lower side with a ring 21 of synthetic material which comprises the gear ring 15.

After having been fully wound, the core 11 can be removed from the device by removal of the rollers 13 and by hinging out the part 22 of winding wheel 1, the said part being pivotable about the shaft 23.

The operation of this device is as follows. Wire 25 is guided from a feed reel 24 to the winding wheel 1 and, via the braking rollers 26 and take-off to the core 11 where it is attached. As shown in FIG. 1, the wire passes under a guide wheel 8, over a number of rollers 7 around the periphery of the winding wheel, then undulates alternately over a series of braking rollers 26 and rollers 7, and is taken off from a point 35 on a roller 7.

Figure 2:
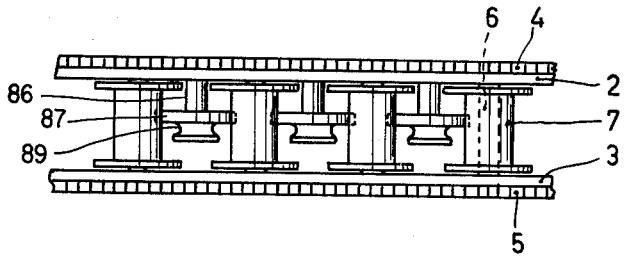
FIG. 2 is a view of the portion A—A of the winding wheel of the device shown in FIG. 1.

As shown in FIGS. 1 and 2, each braking roller 26 is rotatably mounted on a shaft 86, and includes a large diameter wheel portion 87 and a smaller diameter portion having a groove 89. The wheel portion 87 engages and is driven by the wire-carrying surface of rollers 7, but because of the greater diameter of the wheel 87, it rotates more slowly. The groove 89, rotating with the wheel 87, therefore has a lower surface speed than the rollers 7. The wire 25, moving at a speed relative to the wheel 1 equal to the surface speed of the rollers 7, and passing over and in contact with the lower surface speed of the grooves 89, is therefore braked.

Subsequently, the winding wheel 1 is rotated by means of pinion 10. The wire is then wound about the core 11, but wire is also wound from the feed reel 24 onto the rollers 7 of wheel 1. Because the circumference of winding wheel 1 is larger than the length of one turn about the core 11, the winding of the wire onto the winding wheel will be quicker than the unwinding therefrom. When the winding wheel contains enough wire for winding the complete core 11, the wire 25 is cut by means of shears 27.

During the winding the core 11 is controlled by the motor 18 which is suitably programmed. The core is moved between the deposition of the wire on the upper and the lower ring of synthetic material, with the result that the turns are arranged to be slanted on the core in accordance with the extent of rotation of the core. It is also possible to move the core during the deposition of the wire on the inner surface of the core such that the wire extends according to a geodetic line. This offers the advantage that once the wire has thus been positioned it no longer tends to shift so that a reliable winding is obtained.

The turns can alternatively be made to extend according to a geodetic line on the inner surface of the core in a simpler manner by arranging the winding wheel 1 very near to this surface. However, in that case the center of this wheel cannot be positioned in the space bounded by the envelope of the turns on the outer surface and the inner surface. If the center of the winding wheel is situated in this space, it is not necessary to take back wire during the winding.

In the device shown in FIG. 1 the center 30 of the winding wheel is situated within the space bounded by the turns 31 on the outer surface and the inner surface 32 of the core. It clearly shows that the distance between the angular point 34 and the point 35 where the wire is taken off from the winding wheel continuously increases, which means that the wire always remains taut and that no wire need be taken back. The same occurs from angular points 36, 37, 38 and 39, so that in all sectors the distance between the point of deposition on the core and the take-off point 35 continuously increases.

As a result, the winding wheel can have a very simple construction; however, the diameter must be small but this is also an advantage because the inertia forces occurring will also be small.

When the center 30 is arranged in the described location, the winding wheel cannot become near to the inner surface of the core. It can be simply ensured that the turns still extend according to a geodetic line over the inner surface by arranging a wire guide 40 near to the inner surface of the core in the plane of the winding wheel, the said wire guide consisting of two parallel structural parts, only one of which is visible in the drawing. The wire then passes from the winding wheel through the wire guide 40 to the surface of the core on which it extends according to the geodetic line.

A winding device is thus obtained by means of which toroidal deflection coils with straight as well as slanted turns can be simply manufactured.

Figure 3:
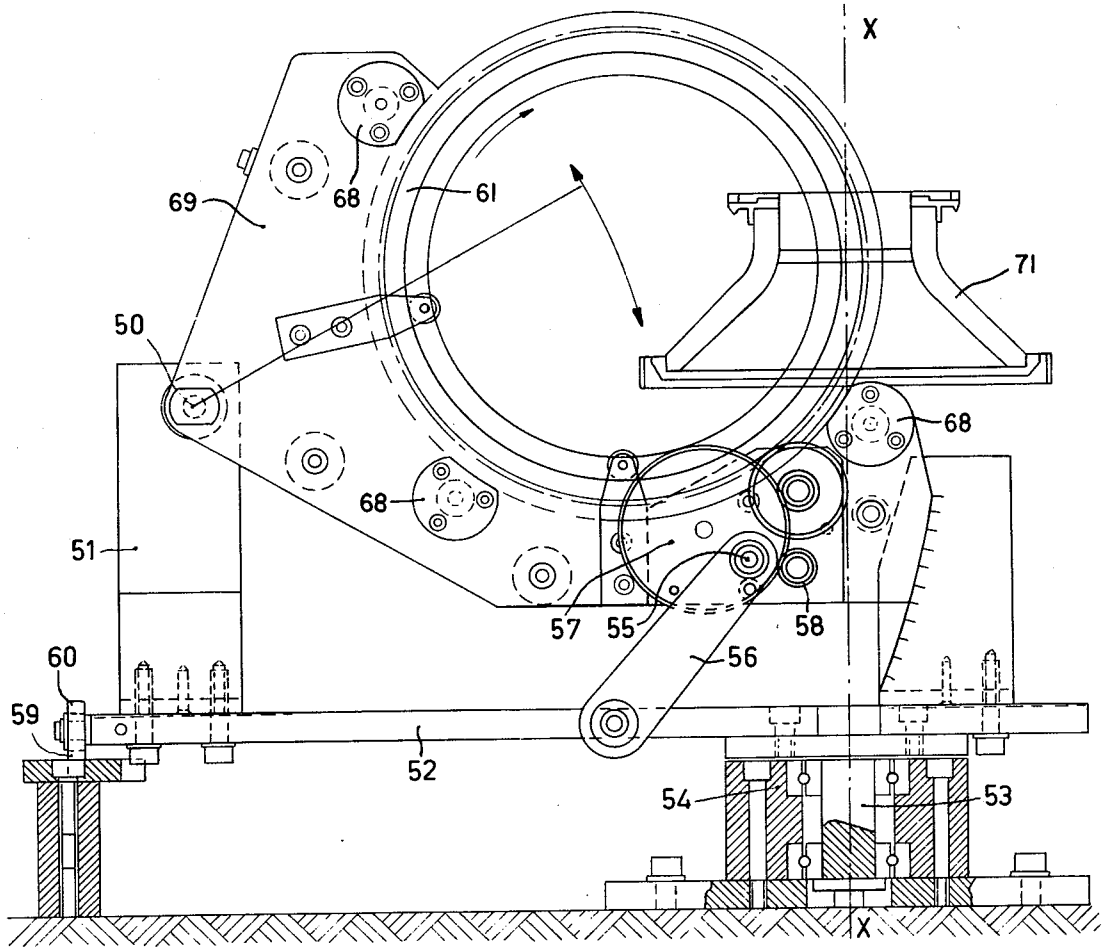
FIG. 3 is a diagrammatic view of another embodiment of a winding device.

FIG. 3 is a diagrammatic representation of a slightly modified embodiment of the machine shown in FIG. 1. In this embodiment, the winding wheel 61 is journalled in a frame 69 which is connected to a column 51 on table 52 via a hinge 50. Table 52 comprises a shaft 53, the axis $x$—$x$ of which coincides with the axis of a core 71. The shaft 53 is journalled to be rotatable in bearing 54, with the result that the table 52 and hence the winding wheel connected thereto can rotate about the axis $x$—$x$. The frame 69 is furthermore connected to table 52 via a crank connecting rod mechanism 55–56. The crank 55 is mounted on a gearwheel 57 which can be rotated by way of a pinion 58 which is connected to a motor not shown.

The rotation of the table 52, on which the entire winding wheel and its drive are mounted, about the axis $x$—$x$, and therefore with respect to the core 71, is effected by means of a rack and pinion combination 59–60, the pinion 60 of which can be driven by a drive unit not shown. This eliminates the need to rotate the core 71 about the axis *x—x*.

The arrangement of the core 71 in the device and the construction of winding wheel 61 are in accordance with the construction shown in FIG. 2 and are not further elaborated herein for the sake of clarity. Similarly, the driving mechanism for the winding wheel is like that shown in FIG. 1, and is not shown in FIG. 3.

The operation of this device is as follows: when the wire is deposited on the inner side of the core, the frame 69 and winding wheel 61 are moved upwards by means of the crank connecting rod mechanism 55, 56, 58, with the result that the winding wheel is positioned near to substantially the entire inner surface of the core closest to the hinge 50. During the deposition of a turn on the outer side of the core, the wheel is displaced down again, thus avoiding the necessity of taking back wire onto the winding wheel again. In addition, a swinging movement about the axis *x—x* is imparted to the winding wheel by means of the rack and pinion combination 59–60 to permit slant winding. The combination of the said two motions of the winding wheel is chosen such that the windings on the inner surface of the core extend very accurately according to a geodetic line, while at the same time preventing development of slack in the wire.

What is claimed is:

1. A device for winding toroidal coils about a toroidal core having an axis, comprising a winding wheel rotatable about an axis, said wheel comprising a wire take-off device and a removable portion for insertion of a toroidal core to be wound, means for mounting the toroidal core and said winding wheel such that said winding wheel passes through an interior space of the core, means for providing relative angular motion about said core axis between said core and said winding wheel, and means for providing oscillatory displacement of said winding wheel axis with respect to said core in addition to said relative rotation, whereby slack in the wire may be taken up.

2. A device as claimed in claim 1, wherein said winding wheel comprises at least one annular flange coaxial with said wheel axis, and a multiplicity of rollers which are mounted to said flange and are rotatable about axes parallel to said wheel axis so arranged that said rollers form a reel about which wire can be wound.

3. A device as claimed in claim 1, wherein said relative motion means comprises a shaft having an axis coincident with said core axis, a table mounted on said shaft for rotation about said shaft axis, and means for pivoting said table about said shaft axis, and wherein said oscillatory displacement means is mounted on said table.

4. A device as claimed in claim 3, wherein said means for displacing provides at least a component of relative wheel axis movement parallel to said core axis.

5. A device as claimed in claim 1, wherein said core has upper and lower faces, and said means for providing relative motion comprises means for holding and rotating the core comprising a plurality of rollers for the lower side and a plurality of rollers for the upper side, so that the core can rotate between corresponding rollers, and programmable means for rotating said core about the core axis.

* * * * *